United States Patent [19]

Massey et al.

[11] 4,373,864

[45] Feb. 15, 1983

[54] SYSTEM FOR PUMPING FLUIDS AT CONSTANT PRESSURE

[75] Inventors: Lester G. Massey, Moreland Hills, Ohio; Robert I. Brabets, Lombard; William A. Abel, Joliet, both of Ill.; James K. Anderson, Gary, Ind.; Thomas J. Labus, Downers Grove; Davis A. George, Park Forest, both of Ill.

[73] Assignee: CNG Research Company, Cleveland, Ohio

[21] Appl. No.: 127,738

[22] Filed: Mar. 6, 1980

[51] Int. Cl.[3] ..... F04B 49/00

[52] U.S. Cl. ..... 417/46; 60/452; 60/468; 417/213; 417/307; 417/313

[58] Field of Search ..... 417/46, 47, 43, 213, 417/26, 307, 310, 218, 222, 313, 900; 60/450, 452, 468; 137/596.13; 241/5, 21, 17, 23

[56] References Cited

U.S. PATENT DOCUMENTS

| | | | |
|---|---|---|---|
| 1,042,980 | 10/1912 | Shawver | 417/46 |
| 2,467,398 | 4/1949 | Miller | 417/46 X |
| 2,560,807 | 7/1951 | Lobo . | |
| 2,648,950 | 8/1953 | Miller . | |
| 2,669,509 | 2/1954 | Sellers . | |
| 2,830,769 | 4/1958 | Work | 241/21 X |
| 3,168,350 | 2/1965 | Phinney et al. . | |
| 3,219,259 | 11/1965 | Horton | 417/46 |
| 3,715,195 | 2/1973 | Tassoney et al. . | |
| 3,715,301 | 2/1973 | Tassoney et al. . | |
| 4,028,890 | 6/1977 | Habiger et al. | 417/218 X |
| 4,122,865 | 10/1978 | Budzich | 137/596.13 |

*Primary Examiner*—Edward K. Look

*Attorney, Agent, or Firm*—Allegretti, Newitt, Witcoff & McAndrews

[57] ABSTRACT

A constant pressure system for pumping a coal slurry includes a slurry pump mechanically driven by a hydraulic motor which, in turn, is driven by a hydraulic pump. The output of the hydraulic pump is controlled by a pressure sensitive flow control valve that maintains the hydraulic fluid pressure drop as a constant across the hydraulic motor. The system assures a constant hydraulic motor output torque, driving the slurry pump at a constant delivery pressure.

9 Claims, 3 Drawing Figures

SYSTEM FOR PUMPING FLUIDS AT CONSTANT PRESSURE

BACKGROUND OF THE INVENTION

The present invention relates to a system for pumping fluid at a constant, high pressure into a reaction vessel or other container, particularly a vessel used in the explosive comminution of coal into fine particles.

Explosive comminution of coal may be accomplished by raising the pressure and temperature of a coal-fluid slurry, preferably coal-water, then suddenly lowering the pressure of the slurry, for example by forcing the slurry through a pressure reducing orifice. The pressure reduction effects a rapid expansion of the fluid in the coal particles, causing the coal to shatter or explode into smaller sized particles.

Coal slurries, however, are difficult to handle particularly at high temperatures, due to the tendency of coal particles in the slurry to agglomerate. Such agglomeration can partially or fully plug the pressure reducing orifice thereby producing sudden and severe pressure increases within the comminution system. Continued pumping of a slurry in a plugged system can ultimately cause damage to the system, for example, by causing rupture of pipes or vessels, or destruction of pumps. However, if the feed pump for the comminution system is designed to deliver the slurry at a constant pressure, then the delivery rate of the slurry is inherently adjusted, decreased or stopped so as to maintain a safe pressure.

Conventional constant pressure feed pumps utilize a feed back loop around the pump. The loop includes a pressure actuated valve that may be actuated to divert the pumped fluid into the feedback loop whenever a threshold pressure is sensed at the pump head. However, when an abrasive slurry, such as a coal slurry, flows through the feedback loop, the control valve is severely abraded making it unsuitable for use in a relatively short time. Such a bypass system may also cause undesirable rapid heating of the fluid being pumped in the feedback loop as the pump continuously circulates the fluid through the loop.

The present invention was devised to overcome certain problems discovered in these conventional systems. The invention provides a system for delivering fluids, particularly abrasive slurries such as a slurry of coal and water, at a constant high pressure in a manner which protects the integrity of the pumping system and the vessel or device which receives the slurry.

SUMMARY OF THE INVENTION

Accordingly, it is an object of the present invention to provide an apparatus for pumping a fluid to a high pressure at a substantially constant pressure.

Another object of the present invention is to provide an apparatus for pumping a fluid to a vessel at a rate which varies inversely with changes of the pressure within the vessel.

A further object of the invention is to provide an apparatus for pumping a fluid to a vessel which will protect the pumping system from the effects of adverse pressure changes within the vessel.

A still further object of the invention is to provide an apparatus for pumping abrasive slurries which will protect the pressure control system from the abrasive effects of the slurry.

Yet another object of the invention is to provide a constant pressure pumping system which avoids overheating of the pump.

One further object of the invention is to provide a pumping system for an agglomerating coal slurry at high temperature and pressure for subsequent explosive comminution.

In a broad embodiment, the apparatus of the present invention comprises a pumping system which delivers fluid to a vessel or the like at a substantially constant pressure. This system includes a hydraulic pump preferably driven by a constant speed motor. The hydraulic pump delivers an adjustable rate of hydraulic fluid to a hydraulic motor. The hydraulic motor, in turn, mechanically drives a separate slurry feed pump. The hydraulic motor produces a driving force for the slurry feed pump in an amount which is directly proportional to the pressure drop of hydraulic fluid across the hydraulic motor.

A pressure sensitive flow control valve maintains a substantially constant pressure drop across the hydraulic motor by varying the amount of hydraulic fluid flowing to the hydraulic motor. As the pressure drop across the hydraulic motor increases, the pressure sensitive valve decreases the flow of hydraulic fluid through the hydraulic motor, thus decreasing the pressure drop across the hydraulic motor to a predetermined level. Alternatively, as the pressure drop across the hydraulic motor decreases, the flow of hydraulic fluid through the hydraulic motor is increased. As a result of such adjustments, the hydraulic motor generates a substantially constant driving torque.

By maintaining pressure drop across the hydraulic motor constant, the pressure sensitive valve also functions to maintain the slurry feed pressure constant. That is, the pressure output of the slurry pump is a function of the hydraulic motor's driving torque output. Thus, the pressure drop across the hydraulic motor and the pressure output from the slurry feed pump are inherently and directly proportional. When the pressure sensitive flow control valve measures the pressure drop across the hydraulic motor, it is also cooperating with the hydraulic motor and the slurry feed pump to, in effect, sense the pressure output of the slurry feed pump. Similarly, when the pressure sensitive flow control valve adjusts or maintains constant the pressure drop across the hydraulic motor, it simultaneously adjusts or maintains constant the pressure output of the slurry feed pump.

The hydraulic fluid pump, the hydraulic motor and the pressure sensing flow control valve control the slurry feed pressure in an indirect manner. This system is preferred for use in delivering abrasive slurries such as coal-water slurries because the abrasive slurry never contacts the pressure sensing valve. This design greatly extends the useful life of the control loop and valve.

BRIEF DESCRIPTION OF THE DRAWING

In the detailed description which follows, reference will be made to the drawing comprised of the following figures.

DESCRIPTION OF THE PREFERRED EMBODIMENT

Figure 1:
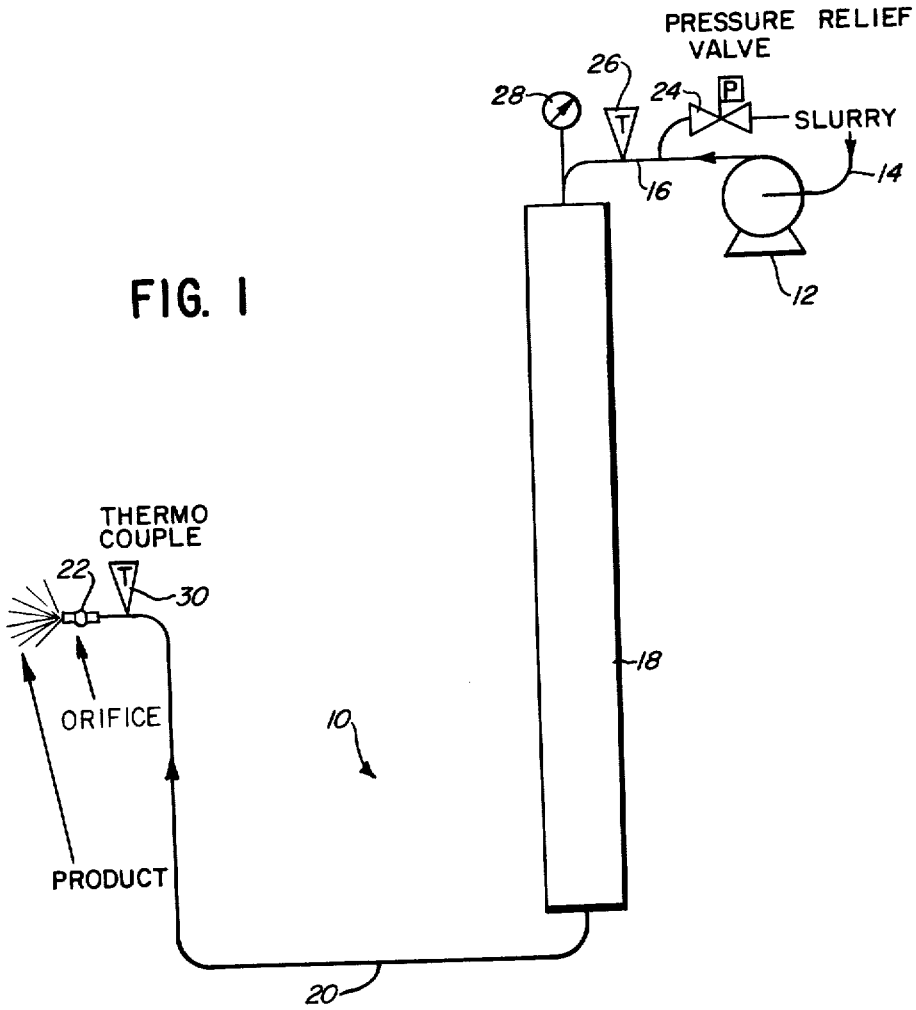
FIG. 1 is a schematic flow diagram of a coal comminution system which includes the pumping system of the present invention.

Referring to FIG. 1, the pumping system of the present invention is schematically shown as a pump mechanism 12 incorporated in an explosive comminution system 10. The mechanism 12 delivers a slurry of coal and water into the comminution system 10. The explosive comminution system 10 and its overall operation are explained in greater detail in a copending application of Massey, et al., titled "Method For Separating Undesired Components From Coal by an Explosion Type Comminution Process", Ser. No. 127,740, now U.S. Pat. No. 4,313,737, filed concurrently with the application for the present invention and incorporated by reference herein.

Briefly, in the system 10, a slurry of ground coal and water is prepared and passed via inlet line 14 to pump mechanism 12 which delivers the slurry through outlet line 16 to a heating chamber 18 at a predetermined high pressure. The pressure of the slurry in line 16 is above the critical pressure of the liquid and preferably less than about 16,000 pounds per square inch absolute ("psia"), most preferably within the range of about 6,000 to 14,000 psia.

The temperature of the slurry in heating chamber 18 is raised to a level above the critical temperature of the liquid and preferably less than about 1,000° F. For coal-water slurries particularly preferred temperatures are about 750° F. to 950° F.

The slurry is then passed from heater 18 through line 20 to be discharged from orifice 22 into a zone of lower pressure, e.g. atmospheric pressure. Orifice 22 provides a substantially instantaneous transition of the slurry from the temperature and pressure conditions inside the heating chamber 18 to those of the lower pressure environment.

Since the pressure within the explosive comminution system 10 is relatively high, a pressure release valve 24 is provided to relieve pressures which exceed the design safety factor. In addition, the pressure within heating chamber 18 is continuously measured by a pressure gauge 28. The temperature of the slurry is measured by thermocouples 26 and 30.

The pressure within the system 10 is primarily determined by the delivery pressure of slurry to the heater 18. In theory, the explosive comminution system 10 will operate at steady state conditions including constant pressure if the feed pump mechanism 12 delivers the slurry to the heating chamber 18 at a constant rate and the slurry discharges from the orifice 22 at the same constant rate. In practice, sudden, severe and unpredictable pressure fluctuations can and do occur.

The slurry pumping mechanism 12 of this invention counteracts pressure changes within the system 10 by providing a constant delivery pressure. Consequently the rate at which slurry is delivered to the system 10 decreases when the pressure in the system 10 increases, for example as a result of partial plugging of orifice 22, or increases when the pressure in the system 10 decreases.

Figure 2:
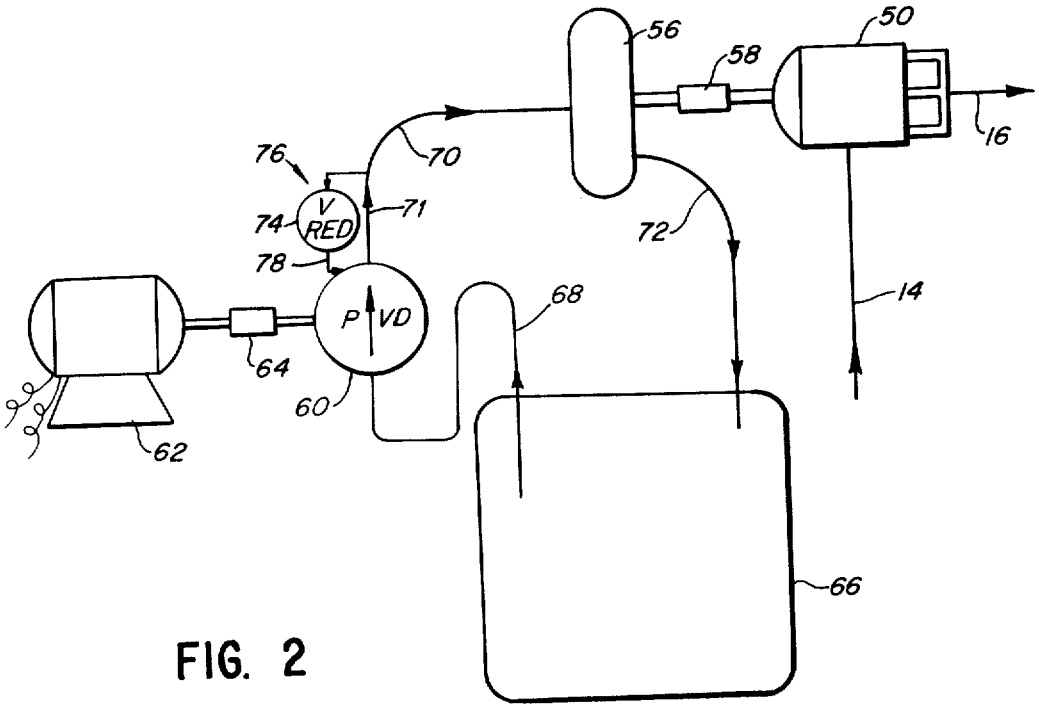
FIG. 2 is a diagramatic view of the preferred embodiment of the pumping system of the invention.

The components of the slurry pumping mechanism 12, are shown schematically in FIG. 2. A slurry feed pump 50 receives slurry from inlet line 14 and delivers the slurry at the desired pressure to the chamber 18 (not illustrated in FIG. 2) via outlet line 16. The feed pump 50 is desirably a positive displacement type, such as a piston or plunger design, but may be any type of pump wherein the delivery pressure is directly related to the driving force applied to operate the pump 50. Pumps of this design are well suited to providing the high operating pressures necessary for explosive comminution.

The feed pump 50 is connected through a conventional mechanical drive connection 58 to a hydraulic motor 56. The delivery pressure of the feed pump 50 is directly related to the driving torque produced by the motor 56.

Hydraulic motor 56 is of a commercially available piston or turbine design. Preferably hydraulic motor 56 is a radial piston type wherein the rate at which the motor 56 is operated is directly proportional to the rate at which a hydraulic fluid is passed through it. The amount of driving force or torque produced by the hydraulic motor 56 is directly related to the hydraulic fluid pressure drop across the motor 56. As a result of these design features, the delivery pressure of pump 50 is directly related to this pressure drop.

A hydraulic fluid pump 60 is driven by a constant speed motor 62 to pump hydraulic or other suitable fluid. The hydraulic pump 60 and constant speed motor 62 are of a conventional design and are interconnected by a conventional drive connection 64.

The hydraulic fluid is drawn from a hydraulic fluid reservoir 66 by a line 68 and passed via lines 71 and 70 through the hydraulic motor 56, thus producing the desired pressure drop and associated driving force. The hydraulic fluid is then returned to the hydraulic reservoir 66 by line 72.

The hydraulic fluid pressure drop across the motor 56, and thus the driving force of motor 56 and delivery pressure of slurry feed pump 50, are maintained constant by adjusting the flow rate of hydraulic fluid from the hydraulic pump 60 through the hydraulic motor 56. In preferred form, the device for adjusting the hydraulic fluid flow rate is a pressure sensitive flow control valve 74.

Valve 74 adjusts the fluid flow rate of the hydraulic pump 60 in response to pressure change across the hydraulic motor 56. Typically, the pressure sensitive valve 74 is of a valve-type that rotates a swash plate in pump 60, thereby decreasing or increasing the output flow rate of the pump 60, as the pressure across the motor 56 increases or decreases, respectively.

The pressure sensitive flow control valve 74 is incorporated in a control loop 76, one end of which preferably connects to line 71 so that the valve 74 measures the pressure at the inlet of the motor 56. This pressure measurement effectively indicates the hydraulic fluid pressure drop across motor 56, assuming the pressure in reservoir 66, and line 72 are constant. Thus the loop 76 utilizes feedback of this pressure drop through valve 74 and line 78 to adjust the output of pump 60.

There is minimal fluid flow in the pressure sensing flow control loop 76. Substantially all of the fluid flow produced by pump 60 is directed through motor 56 and discharged to fluid reservoir 66. Thus, substantially no excess flow is generated. Since the energy associated with excess flow would be dissipated as excess heat, representing a waste in energy, the preferred embodiment is highly energy efficient. Equally significant, heat build-up in the pump 60 and feedback loop 76 is avoided thereby extending their useful lives.

Importantly, the pump 60, hydraulic motor 56 and pressure sensing valve 74, contact only the hydraulic fluid and not the feed slurry. As a result, these components of the pumping mechanism are protected from the abrasive action of the slurry.

Figure 3:
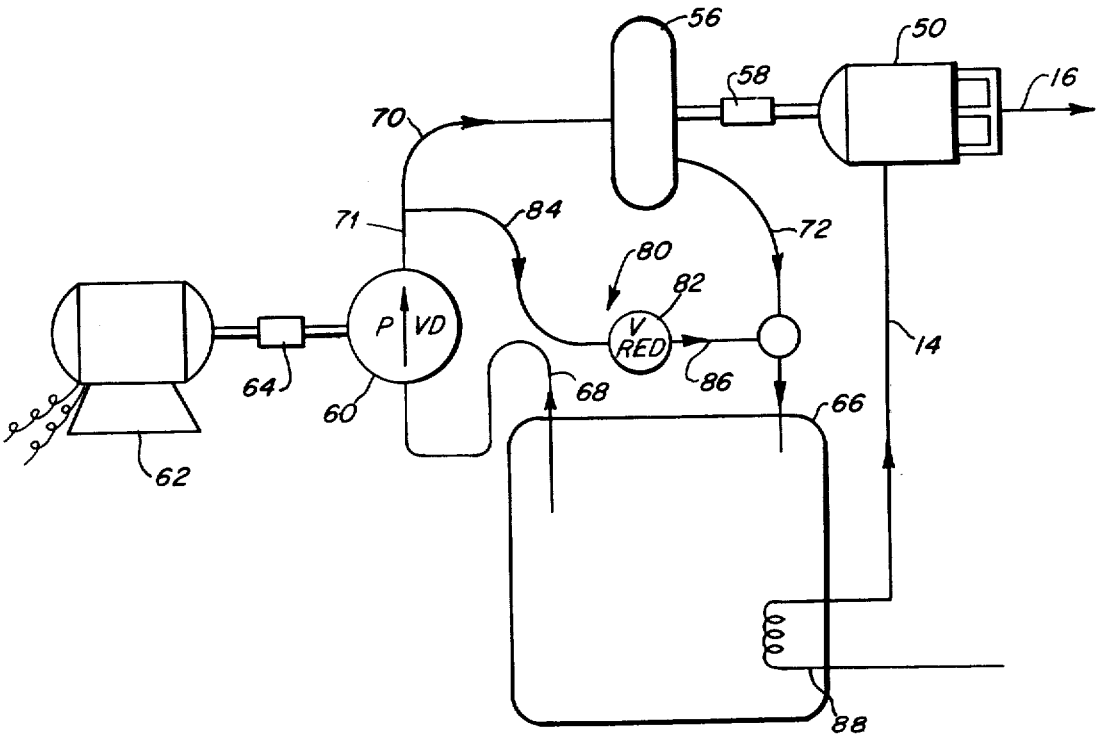
FIG. 3 is a diagramatic view of an alternative embodiment of the invention.

In an alternative embodiment, shown in FIG. 3, the pump 60 produces a substantially constant output or fluid flow. A bypass loop 80 has lines 84 and 86 connecting a pressure sensitive valve 82 across motor 56 between the inlet line 70 and the discharge line 72. The pressure drop across valve 82 is substantially equal to the pressure drop across the motor 56. Hydraulic fluid passing through the bypass loop 80 is returned to the hydraulic fluid reservoir 66 by line 86 in admixture with the hydraulic fluid discharged through line 72 from motor 56.

The pressure sensitive valve 82 is designed to open in response to increasing pressure drops and to close in response to decreasing pressure drops, thus allowing more or less fluid through the bypass loop 80 in response to a respectively increasing or decreasing pressure drop across the motor 56. The valve 82 thus insures that the pressure drop across the motor 56 is substantially constant.

The relatively high residence time of the hydraulic fluid within the reservoir 66 permits the hydraulic fluid to cool before it is returned to motor 56 and pump 60. The cooling of the hydraulic fluid avoids overheating that would occur if the discharge from line 86 were passed directly to the pump 60.

The degree of cooling may be increased by placing cooling coils 88 in the reservoir 66. The feed fluid, i.e. coal water slurry, is preferably passed through the cooling coils 88 so that the cooling coils 88 are employed to pre-heat the feed slurry and thereby improve system energy efficiency.

Increases in pressure drop across hydraulic motor 56 are attributable to an increase in flow resistance within the explosive comminution system and/or orifice 22. The pressure sensing flow control loop 76 or 80 and pressure sensitive valve 74 or 82 cooperate with the pump 60, hydraulic motor 56 and feed pump 50 to convert these changes in flow resistance into changes in hydraulic fluid rate through motor 56. This conversion is then applied by cooperative action of the components to alter the delivery rate of the feed slurry so that the pressure within the system 10 remains substantially constant.

The above description relates to a preferred embodiment of the invention. However, alternative configurations and modifications are possible within the scope of the invention. Various types of fluid pumps, hydraulic motors, hydraulic fluid pumps and valves other than those identified herein may be used. The design of these components may also vary with the type of feed fluid or hydraulic fluid. In addition, the design of the component members is likely to vary with the desired pressures for the explosive comminution system. Therefore, the subject matter of the invention is to be limited only by the following claims and their equivalents.

What is claimed is:

1. A pump system for pumping a first fluid at a substantially constant pressure regardless of fluid flow rate, said system comprising in combination:

(a) a pump for said first fluid, said pump having a first fluid inlet, a first fluid outlet and means for pumping the first fluid from the inlet through the outlet;

(b) a fluid motor for directly and mechanically driving the means for pumping; and (c) adjustable means for driving the fluid motor, said adjustable means including means for sensing the relative pressure drop across the fluid motor and for adjusting the torque output of the fluid motor in inverse relationship to the pressure drop across the fluid motor such that the first fluid is pumped at a substantially constant pressure regardless of fluid flow rate.

2. The pump system of claim 1 in combination with a system including at least one vessel for heating a slurry downstream from the pump system and a discharge nozzle downstream from the vessel.

3. The pump system of claim 2 including means for preheating the first fluid prior to said inlet.

4. The pump system of claim 3 wherein said means for preheating comprise a heat exchanger incorporated as part of the adjustable means for driving, said heat exchanger adapted to remove excess heat from the adjustable means for driving.

5. A system for pumping a coal slurry at a substantially constant pressure regardless of fluid flow rate of the slurry, said system comprising, in combination:

(a) a first pump for pumping said coal slurry, said first pump having a first pump fluid inlet, a first pump fluid outlet, and first pump means for moving the coal slurry from the inlet through the outlet;

(b) a fluid motor for directly and mechanically driving the first pump, said fluid motor having a motor fluid inlet and a motor fluid outlet;

(c) a second pump for pumping a hydraulic fluid to drive the fluid motor, said second pump being a variable volume pump and having a second pump fluid inlet, a second pump fluid outlet, and second pump means for moving the hydraulic fluid from the inlet through the outlet;

(d) an hydraulic fluid line connecting the second pump fluid outlet to the motor fluid inlet, such that the hydraulic fluid output of the second pump drives the fluid motor; and (e) an hydraulic feedback means for delivering a portion of the hydraulic fluid output from said second pump back into said second pump in response to the pressure of the hydraulic fluid in the hydraulic line, such that changes in the flow of hydraulic fluid back into said second pump through said feedback means adjust the volume of hydraulic fluid output from the second pump;

(f) said fluid motor, said second pump, said hydraulic feedback means, and said hydraulic fluid line defining means for adjusting the pressure of coal slurry from said first pump by using the hydraulic fluid output of the second pump to directly adjust the volume output of said second pump and thereby maintain the delivery pressure of the coal slurry substantially constant.

6. The system of claim 5 wherein said hydraulic feedback means includes a pressure sensitive flow control valve that responds to the pressure of the hydraulic fluid in the hydraulic fluid line and, in response thereto, as said pressure rises, allows an increased flow of said hydraulic fluid through the hydraulic feedback means and back into the second pump, and vice versa, to produce a constant torque of the fluid motor.

7. A system for pumping a coal slurry at a substantially constant pressure regardless of fluid flow rate of the slurry, said pump system comprising, in combination:

(a) a first pump for pumping said coal slurry, said first pump having a first pump fluid inlet, a first pump fluid outlet, and first pump means for moving the coal slurry from the inlet through the outlet;

(b) a fluid motor for directly and mechanically driving the first pump, said fluid motor having a motor fluid inlet and motor fluid outlet;

(c) a second pump for pumping hydraulic fluid to drive the fluid motor, said second pump having a second pump fluid inlet, a second pump fluid outlet, and second pump means for moving the hydraulic fluid from the inlet through the outlet;

(d) an hydraulic fluid line connecting the second pump fluid outlet to the motor fluid inlet, such that the hydraulic fluid output of the second pump drives the fluid motor; and (e) an hydraulic bypass means to direct the flow of a portion of the hydraulic fluid around said fluid motor in response to the pressure drop across the fluid motor, such that changes in the pressure drop across the fluid motor adjust the volume of hydraulic fluid flow through the fluid motor;

(f) said fluid motor, said second pump, said bypass means, and said hydraulic fluid line defining means for adjusting the pressure of coal slurry from the first pump by using the pressure drop across the fluid motor to directly control the torque output of said fluid motor and thereby maintain the delivery pressure of the coal slurry substantially constant.

8. The system of claim 7 wherein said hydraulic bypass means includes a pressure sensitive flow control valve that responds to the pressure drop across said fluid motor, and, in response to increases in said pressure drop, the hydraulic bypass means increases the flow of hydraulic fluid from said hydraulic fluid line around said fluid motor, and vice versa, to produce a constant output torque of the fluid motor.

9. The pump system of claims 5 or 7 wherein the only fluid that contacts the means for adjusting the pressure of the coal slurry is the hydraulic fluid from the second pump.

* * * * *